United States Patent [19]

Krokor et al.

[11] Patent Number: 4,729,517

[45] Date of Patent: Mar. 8, 1988

[54] REBOUND CRUSHER

[75] Inventors: Werner Krokor, Beckum-Neubeckum; Wolfgang Finken, Ennigerloh; Bernhard König, Augsburg, all of Fed. Rep. of Germany

[73] Assignee: O&K Orenstein & Koppel Aktiengesellschaft, Dortmund, Fed. Rep. of Germany

[21] Appl. No.: 879,644

[22] Filed: Jun. 27, 1986

[30] Foreign Application Priority Data

Jul. 13, 1985 [DE] Fed. Rep. of Germany ..... 3525101

[51] Int. Cl.[4] ..... B02C 13/06

[52] U.S. Cl. ..... 241/189 R; 241/289

[58] Field of Search ..... 241/189 R, 287–290, 241/231–234, 121, 32, 259.3

[56] References Cited

U.S. PATENT DOCUMENTS 3,315,902 4/1967 Pollitz ..... 241/231
4,017,035 4/1977 Stuttmann ..... 241/189 R

FOREIGN PATENT DOCUMENTS 2037104 2/1972 Fed. Rep. of Germany ... 241/189 R
2311431 9/1974 Fed. Rep. of Germany ... 241/189 R
2340772 9/1977 France ..... 241/189 R

*Primary Examiner*—Mark Rosenbaum
*Attorney, Agent, or Firm*—Martin A. Farber

[57] ABSTRACT

The invention concerns a rebound crusher having at least one rotor provided with hammers which is mounted rotatably in a crusher housing and cooperates with at least one rebound mechanism which is arranged swingable against spring force within the crusher housing and the distance of which from the hammers of the rotor is adjustable. In order, in a space-saving development, to permit remote adjustment of the nip between hammers and rebound mechanism, the rebound mechanism is pivotally connected to the piston rod of a damping piston which rests against the crusher housing and the front end position of which is infinitely variable via an adjustment piston of a setting cylinder.

12 Claims, 4 Drawing Figures

REBOUND CRUSHER

FIELD AND BACKGROUND OF THE INVENTION

The present invention relates to a rebound crusher having at least one rotor provided with hammers which is mounted for rotation in a crusher housing and cooperates with at least one rebound mechanism which is arranged swingable against spring force in the crusher housing and the distance between which and the hammers of the rotor is adjustable.

Rebound crushers of the above-described type whose rebound mechanisms are mounted under spring action with respect to the housing are known. The spring mounting permits the rebound mechanism to move away upon the encountering of large pieces to be crushed, and particularly in the case of foreign bodies such as pieces of metal, in order to avoid damage to the rebound mechanism and the rotor with its hammers. In order to be able to adjust the fineness of the crushed material it is know to adjust the starting position of the rebound mechanism with respect to the hammers of the rotor by means of spindles. In addition to this adjustment of the nip, the spring characteristic of the springs is also selected as a function of the specific material to be crushed.

In the case of rebound crushers of relatively large capacity, the dimensioning and arrangement of the springs and spindles affords problems. Furthermore, it is difficult and time-consuming to adjust the nip in each case. Such an adjustment is, however, not only necessary if wear of the hammers and of the armor plates of the rebound mechanism must be compensated for by readjustment but also if different material is charged in succession into the rebound crusher and/or if different particle sizes of the crushed material are desired.

SUMMARY OF THE INVENTION

The object of the present invention is so to further develop a rebound crusher of the aforementioned type that, with a compact development of the springs and displacement elements, remote adjustment of the nip between hammers and rebound mechanism is made possible.

The solution of this problem by the present invention is characterized by the fact that the rebound mechanism is pivotally connected to the piston rod of a damping piston which rests against the crusher housing and the front end position of which is capable of infinitely variable adjustment via an adjustment piston of a setting cylinder.

By the use of a damping cylinder instead of mechanical springs, high spring forces and spring paths can be obtained in a minimum space; the use of an adjustment cylinder via which the damping piston rests against the housing of the crusher permits an infinitely variable remote adjustment of the nip between the hammers of the rotor and the armor plates of the rebound mechanism.

In order to avoid sealing problems with a given spring force and damping, the interior of the damping cylinder can, in accordance with another feature of the invention, be filled with an elastomer. This elastomer is compressible and flowable but it can be sealed against emergence at considerably little structural expense.

In an alternative embodiment, the interior of the damping cylinder is filled with a pressure liquid and connected with a storage the pretensioning pressure of which is variable so as to adapt the damping characteristic to the specific purpose of use. In accordance with the invention, the storage can be arranged outside the damping cylinder so that protected arrangement at a given place is possible.

In a preferred further development of the invention, the damping cylinder is, at the same time, developed as adjustment piston and arranged displaceably within the setting cylinder. In this way a compact, space-saving construction is obtained which is capable of absorbing high pressure.

The damping cylinder can, in accordance with the invention, be extended in sealed manner out of the rear of the setting cylinder, in which case the adjustment piston rests, via an annular surface surrounding the damping cylinder, against the cylinder bottom of the setting cylinder. This development permits simple connection of a storage to the damping cylinder and easy filling of the damping cylinder with an elastomer.

As an alternative to this, the damping cylinder can also be extended in sealed manner out of the front side of the setting cylinder, in which case the adjustment piston rests via its piston bottom against the cylinder bottom of the setting cylinder. This embodiment results in large supporting surfaces and is therefore suitable for the taking up of large forces.

In order to limit the form-locked fashion the possibility of movement of the rebound mechanism in the direction towards the rotor so that entrance of the rebound mechanism into the beating circle of the hammers is prevented, it is proposed by the invention that a top for the limiting of the movement of the rebound mechanism in the direction towards the rotor be arranged on a rod which is extended in sealed manner out of the rear of the cylinder housing. In the case of a damping cylinder which extends out of the rear of the setting cylinder, this stop can be arranged directly on the damping cylinder. If the damping cylinder is extended out of the front of the setting cylinder, then the stop is arranged on a rod which connects the setting piston with the storage and is conducted in sealed manner out of the cylinder bottom of the setting cylinder.

In accordance with another feature of the invention, for the creation of a preferred embodiment the damping cylinder can rest directly on the crusher housing and the setting piston can be developed as a double piston, one of the pistons of which is arranged in the damping piston while the other is adjustably arranged in the setting cylinder which is developed as an extension of the damping cylinder. In this embodiment also there is obtained a compact structure capable of taking up high forces and which permits, aside from the variation of the damping characteristic, remote adjustment of the nip between hammers of the rotor and rebound mechanism.

It is finally proposed by the invention that a pressure-limiting valve be connected both to the damping cylinder and to the displacement cylinder. The pressure-limiting valve arranged on the damping cylinder releases pressure liquid when an adjustable pressure is reached, so that the damping piston then displaces pressure liquid without additional loading of the storage, whereby overloading of the damping system can be avoided, particularly in the event of the occurrence of large foreign bodies. In these cases, as a result of the pressure-limiting valve which is arranged alternatively or additionally on the displacement cylinder, the result is obtained that the adjustment path of the nip adjustment is also utilized for the moving away of the rebound mechanism upon the occurrence of large foreign bodies, so that maximum escape paths are present.

BRIEF DESCRIPTION OF THE DRAWINGS

Several embodiments of the rebound crusher of the invention are shown in the drawing, in which.

DETAILED DESCRIPTION OF THE PREFERRED EMBODIMENTS

Figure 1:
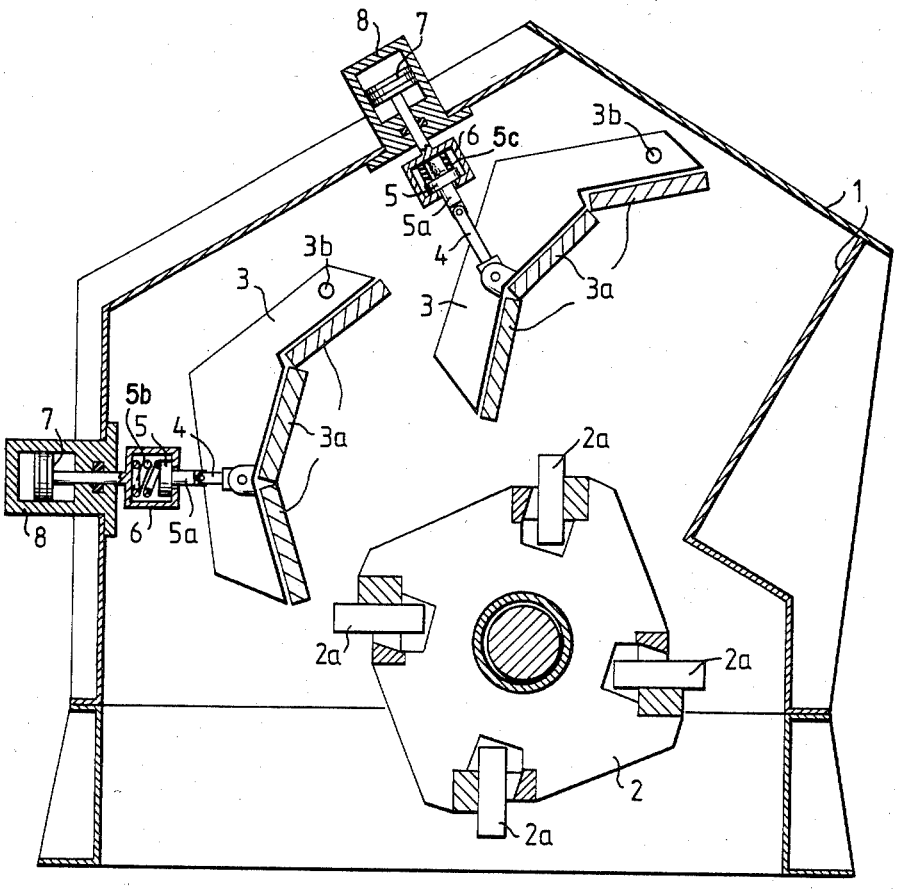
FIG. 1 is a diagrammatic longitudinal section through a rebound crusher with a first possible embodiment, shown diagrammatically, of the damping and setting cylinder of the invention.

FIG. 1 diagrammatically shows a rebound crusher within the crusher housing 1 of which a rotor 2 provided with hammers 2a is rotatably mounted. The material to be crushed which is charged into the rotor 1 is thrown by the crusher arms 2a in the embodiment of FIG. 1 against two rebound mechanisms 3 which are provided on their front surface with armor plates 3a. Each rebound mechanism 3 is swingably mounted in the crusher housing 1 around a pin 3b and rests via a link rod 4 against the piston rod 5a of a damping piston 5 which, in its turn, rests against the crusher housing 1 and the front end position of which is adjustable in infinitely variable manner by an adjustment piston 7 of a setting cylinder 8.

FIG. 1 shows diagrammatically the association of the damping piston 5 arranged within a damping cylinder 6 with the setting cylinder 8. This figure shows that the damping piston 5 arranged within the damping cylinder 6 is acted on by a spring 5b or an elastomer 5c, and that the position of the damping cylinder 6 relative to the crusher housing 1 is infinitely variable by means of the adjustment piston 7 which, in its turn, is guided displaceably within the setting cylinder 8. In this way, the operating position of the rebound mechanism 3 can be displaced infinitely variably by means of the adjustment piston 7, so that the nip between the hammers 2a and the armor plates 3a of the rebound mechanism 3 is adjustable without the actuating of threaded spindles. Starting from this adjustment, the movement of the rebound mechanism 3 is damped by a movement of the damping piston 5 within the damping cylinder 6 against the force of the spring 5b when material to be crushed comes against the armor plates 3a.

Figure 2:
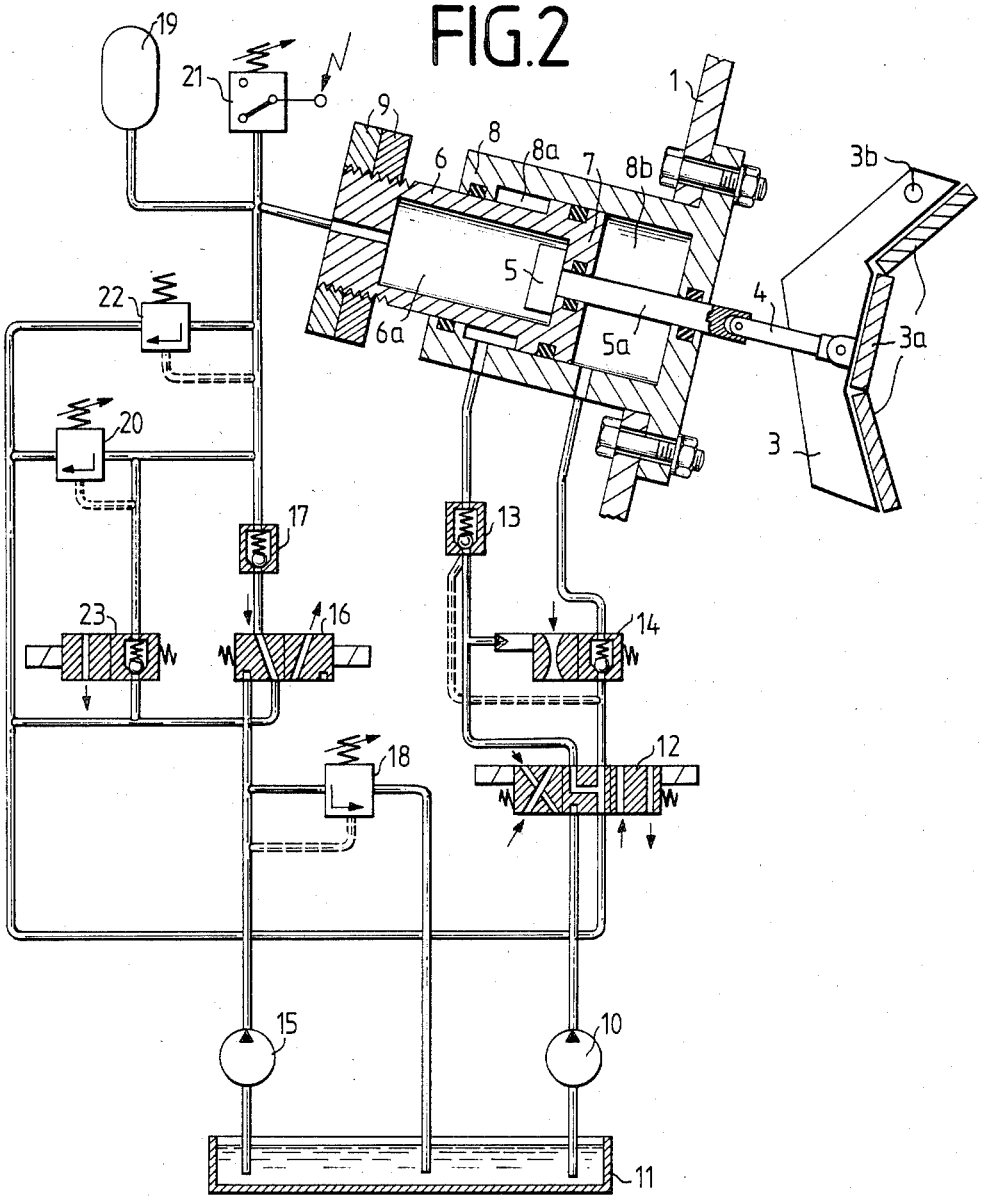
FIG. 2 is a diagrammatic longitudinal section through a second embodiment, in which the damping cylinder, which is developed at the same time as adjustment piston, is extended out of the rear of the setting cylinder.

FIG. 2 shows diagrammatically a first structural embodiment. In this construction, the setting cylinder 8 is fastened to the crusher housing 1 and is provided with a sealed passage opening for the piston rod 5a of the damping piston 5. The damping cylinder 6 is, at the same time, developed as adjustment piston 7 and is accordingly displaceable within the setting cylinder 8. The rear end of the damping cylinder 6 is extended in sealed manner out of the setting cylinder 8 and provided with a stop 9 which limits the movement of the damping cylinder 6, and thus of the damping piston 5 as well as of the rebound mechanism 3 connected by the link rod 4, in the direction towards the rotor 2. In this way, assurance is had that the armor plates 3a of the rebound mechanism 3 cannot come into the circle of movement of the hammers 2a of the rotor 2.

In order to reduce the distance of the rebound mechanism 3 from the hammers 2a in the position of the individual parts shown in FIG. 2, pressure liquid in conducted by a pump 10 from a storage container 11 into the annular space 8a of the setting cylinder 8. For this purpose, the multi-way valve 12 is switched in such a manner that the pressure liquid passes via the openable non-return valve 13 into the annular space 8a. The pressure which builds up in this case in the annular space 8a and its feed lines opens a combined blocking-braking valve 14 via a control line so that pressure liquid can flow back from the piston space 8b of the setting cylinder 8, via the blocking-braking valve 14 and the multi-way valve 12, into the storage container 11. As soon as the desired position of the setting piston 7 has been reached, the blocking-braking valve 14 and the non-return valve 13 close off the feed to and discharge from the setting cylinder 7 without leakage oil, so that said piston remains in its position. The blocking-braking valve 14 furthermore prevents the swinging of the rebound mechanisms 3 as a result of its own weight around the axis 3b.

In order to act with the necessary initial tension on the damping piston which, due to blows against the rebound mechanism 3, can move within the damping space 6a of the damping cylinder 6, pressure liquid is conducted, via a second pump 15 and a multi-way valve 16 as well as a non-return valve 17, into the damping space 6a. The pressure and thus the initial tensioning force are limited by an adjustable pressure-limiting valve 18.

If the forces acting on the rebound mechanism 3 exceed the pretensioning force set, then the damping piston 5 moves into the damping space 6a. The pressure liquid which is displaced thereby flows into a storage 19. If the force exerted on the rebound mechanism 3 drops, then the pressure liquid flows back from the storage 19 into the damping space 6a. The rebound mechanism 3 accordingly assumes its previous starting position since the setting piston 7 has remained unchanged in its position.

Since the pressure prevailing in the system increases upon the displacement of the damping piston 5, another pressure-limiting valve 20 is provided which discharges pressure liquid into the storage container 11 if the maximum pressure set is exceeded, so as to prevent damage to the system. If in such a case the load has again dropped, a pressure switch 21 reports the decrease in the initial tensioning pressure, which is again increased to the set value by means of the pump 15 in the manner described above. Another pressure-limiting valve 22 serves as safety valve for the storage 19 in order to protect it from overload. Complete draining of the storage circuit is possible by means of a valve 23.

If the distance between the rebound mechanism 3 and the hammers 2a (not shown) of the rotor 2 is to be increased in the embodiment shown in FIG. 2, then, by a suitable position of the multi-way valve 12 and blocking-braking valve 14, pressure liquid is pumped from the storage container 11 by means of the pump 10 into the piston space 8*b* of the setting cylinder 8. The increasing pressure opens the openable non-return valve 13 so that the pressure liquid present in the annular space 8*a* can flow back into the storage container 11 via the non-return valve 13 and the multi-way valve 12, in an amount corresponding to the quantity forced into the piston space 8*b*. This is followed by the above-described locking of the position assumed by the adjustment piston 7 within the setting cylinder 8.

Figure 3:
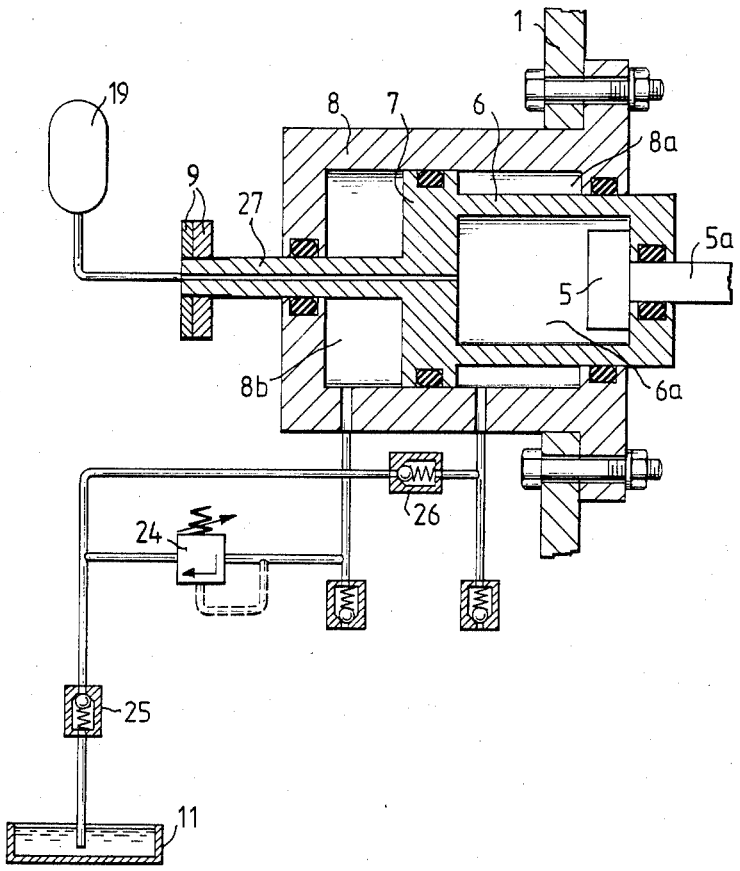
FIG. 3 is another embodiment, corresponding to FIG. 2, with damping cylinder extending out of the front of the setting cylinder.

The further embodiment shown in FIG. 3 differs from the construction of FIG. 2, which has been described above, in the manner that the damping cylinder 6, which is at the same time developed as adjustment piston 7, is extended in sealed manner out of the front of the setting cylinder 8. As a result of this, the piston space 8*b* is on the side opposite the rebound mechanism 3 so that a larger piston area is available to take up the forces exerted on the rebound mechanism 3. In this construction also the same adjustments and displacement are possible as described with respect to FIG. 2. The limiting of the force is effected by means of a pressure-limiting valve 24. If this force is exceeded, pressure liquid flows out of the piston space 8*b* of the setting cylinder 8, via the pressure limiting valve 24 and a pretensioning valve 25, into the storage container 11. A part of the pressure liquid flows in this case over a non-return valve 26 to the annular space 8*a* of the setting cylinder 8. In this way, the latter is completely filled and cavitation is avoided.

Since in the case of the construction described above the adjustment cylinder 7 has left its position, it must be newly adjusted either by path-measurement or a stop. In order to limit the displacement of the adjustment piston 7 in the direction towards the rebound mechanism 3, a stop 9 is again provided, arranged on a rod 27. This rod 27 is fastened on the adjustment piston 7 and extends in sealed manner out of the cylinder bottom of the setting cylinder 8. It serves also for the connecting of the storage 19 to the damping space 6*a* of the damping cylinder 6.

Figure 4:
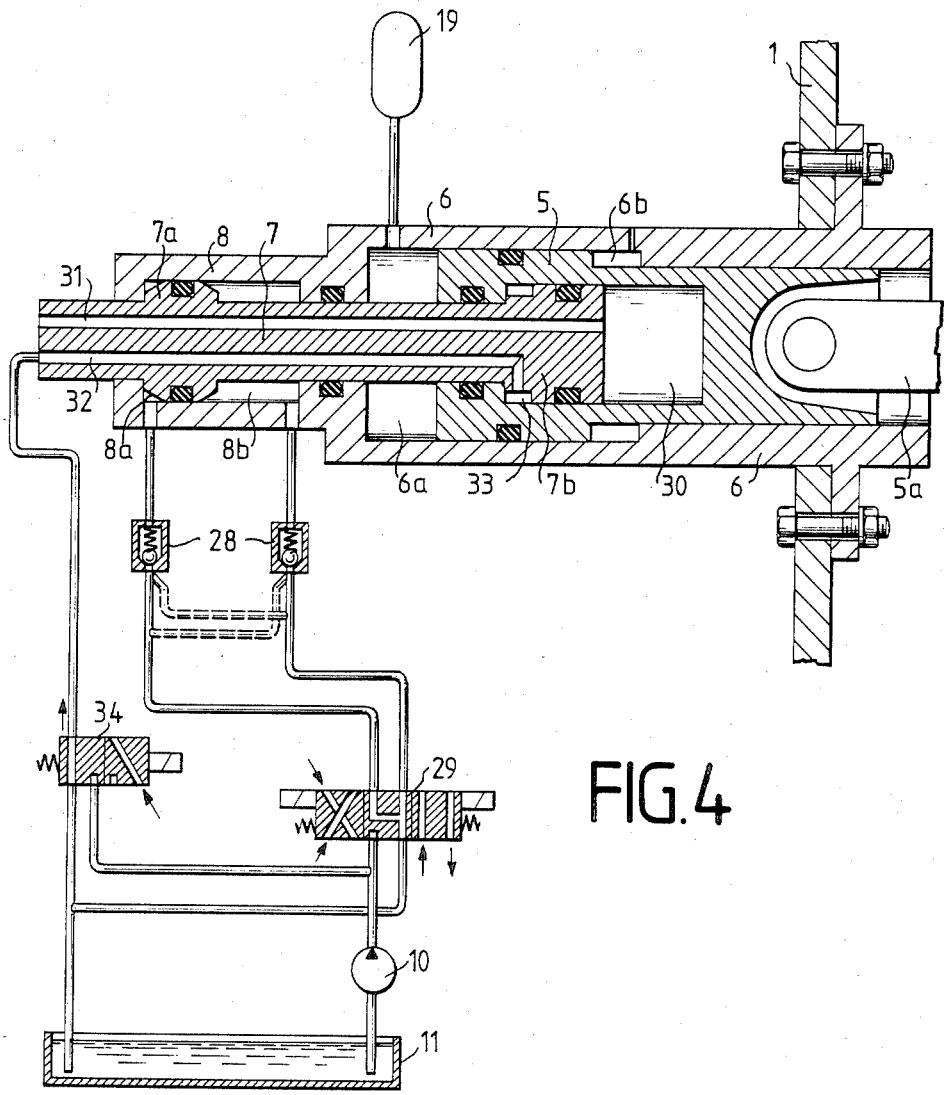
FIG. 4 is a longitudinal section through another embodiment with setting piston developed as double piston.

Finally, the further embodiment shown in FIG. 4 shows a damping cylinder 6 which is fastened directly to the crusher housing 1 and in which the damping piston 5 is displaceably guided. The front part 7*b* of the adjustment piston 7, developed as double piston, extends into said damping piston 5. The rear part 7*a* of this adjustment piston 7 lies in the setting cylinder 8 which adjoins the damping cylinder 6.

Also in the case of this embodiment a storage 19 is connected to the damping space 6*a* of the damping cylinder 6. The annular space 6*b* present on the rod side of the damping piston 5 is in communication with the atmosphere via a vent hole in the case of the construction shown in FIG. 4. The piston spaces 8*a* and 8*b* of the setting cylinder 8 are each connected via a non-return valve 28 to a multi-way valve 29 which, in its turn, is in communication with the pump 10 and with the storage container 11 respectively.

In order to decrease the position of the adjustment piston 7 in the sense of a decrease of the distance between the rebound mechanism 3 and the rotor 2, pressure liquid is pumped by the pump 10, via the multi-way valve 29 and an openable non-return valve 28, into the piston space 8*a* of the setting cylinder 8. Via the other openable non-return valve 28, pressure liquid discharges from the piston space 8*b* through the corresponding position of the multi-way valve 29 into the storage container 11. In order that the front part 7*b* of the adjustment piston 7 can shift within the damping cylinder 5 in the direction towards the rebound mechanism 3, the piston space 30 in the damping piston 5 is in communication with the atmosphere via a bore 31.

If the distance between rotor 2 and rebound mechanism 3 is to be increased, then pressure liquid is forced by the pump 10 via the multi-way valve 29 into the piston space 8*b* of the setting cylinder 8. The pressure liquid flows from the piston space 8*a* via the openable non-return valve 28 and the multi-way valve 29 back into the storage container 11. At the same time, the annular piston space 33 in the damping piston 5 is connected via a bore 32 and via the multi-way valve 34 to the storage container 11.

For purpose of servicing, the distance between rotor 2 and rebound mechanism 3 can be further increased. For this purpose, the annular piston space 33 is connected to the pump 10 via the multi-way valve 34. At the same time, the damping space 61 is connected with the storage container 11, as shown in FIG. 2.

In this construction also, the movements of the damping piston 5 are damped by pressure liquid in the damping space 6*a* which is connected to the storage 19. Since upon the movement of the damping piston 5 the annular piston space 33 is enlarged or reduced in size, pressure liquid can either be drawn out through the bore 32 or pushed out into the storage container 11.

We claim:

1. A rebound crusher comprising a crusher housing, a rebound mechanism disposed within said housing, and at least one rotor provided with hammers and being rotatably mounted in said crusher housing, said rotor cooperating with said rebound mechanism, said rebound mechanism being supported swingably against spring force within the crusher housing, the distance from said rebound mechanism to the hammers of the rotor being adjustable; and wherein said crusher further comprises adjustment means secured to said crusher housing, and having an adjustment piston and a setting cylinder enclosing said piston, damping means interconnecting said adjustment means with said rebound mechanism, said adjustment means adjusting the distance between the hammers and said rebound mechanism, said damping means damping a motion of said rebound mechanism during a crushing of bodies of material placed within said housing; and wherein said setting cylinder is secured to said housing; and said damping means comprises a damping cylinder positioned by said adjustment piston, said damping means further comprising a damping piston enclosed within said damping cylinder and being articulated to a part of said rebound mechanism distant from a point of pivot of said rebound mechanism, said damping piston being moveable independently of a movement of said adjustment piston for operation of said damping means and said adjustment means independently of each other.

2. In an impact crusher comprising a crusher housing and at least one impact mechanism;

at least one rotor which is provided with hammer arms, said rotor being mounted rotatably in the crusher housing and operative with said at least one impact mechanism, said impact mechanism being mounted swingably in the crusher housing so as to move away upon the presence of large pieces of material to be crushed and particularly foreign bodies;

distance means for adjusting the distance of the impact mechanism from the hammer arms of the rotor, the impact mechanism including a setting cylinder, and a piston rod and a setting piston connected together and disposed in the setting cylinder; the impact mechanism being connected continuously displaceable in articulated fashion with the piston rod, the piston resting against the crusher housing; the improvement wherein:

said crusher further comprises a damper cylinder and a damping piston connected to said piston rod, said piston rod serving also as a piston rod for the damping piston; and wherein a front end position of the damping piston is continuously displaceable via the setting piston of the setting cylinder; and said setting piston is moveable within said setting cylinder, said damping piston being moveable within said damper cylinder independently of movement of said setting piston within said setting cylinder for operation of said setting piston and said damping piston independently of each other.

3. A rebound crusher according to claim 2, wherein the damper cylinder encloses a damping space filled with an elastomer.

4. A rebound crusher according to claim 2, wherein the damper cylinder encloses a damping space filled with a pressure liquid, there being a storage connected to the damping space and having a variable pretensioning pressure.

5. A rebound crusher according to claim 4, wherein the storage is arranged outside the damping cylinder.

6. A rebound crusher according to claim 2, wherein the damping cylinder is simultaneously developed as an adjustment piston and is arranged displaceably within the setting cylinder.

7. A rebound crusher according to claim 6, wherein the damping cylinder extends in sealed manner out of the rear of the setting cylinder, and the adjustment piston rests against the cylinder bottom of the setting cylinder via an annular surface surrounding the damping cylinder.

8. A rebound crusher according to claim 6, wherein the damping cylinder extends in sealed manner out of the front of the setting cylinder, and the adjustment piston rests via its piston bottom against the cylinder bottom of the setting cylinder.

9. A rebound crusher according to claim 2, further comprising a stop for limiting movement of the rebound mechanism in a direction towards the rotor, the setting cylinder terminating in a rod which extends in sealed manner out of the rear of the setting cylinder, the stop being disposed on the rod which extends out of the rear of the setting cylinder.

10. A rebound crusher according to claim 2, wherein said damping cylinder rests directly against the crusher housing and the setting piston and is developed as a double piston, one of the pistons of which is arranged in the damping position while the other piston of which is arranged adjustably in the setting cylinder which is developed as an extension of the damping cylinder.

11. A rebound crusher according to claim 2, further comprising a pressure-limiting valve connected to the damping cylinder.

12. A rebound crusher according to claim 2, further comprising a pressure-limiting valve connected to the setting cylinder.

* * * * *